United States Patent [19]

Harper

[11] 3,936,106

[45] Feb. 3, 1976

[54] COMBINATION STEREO-BAR

[76] Inventor: Ernest T. Harper, 4377 N. 90th St., Milwaukee, Wis. 53222

[22] Filed: Aug. 13, 1974

[21] Appl. No.: 496,960

[52] U.S. Cl. ..... 312/107; 312/7 R; 312/223; 312/250; 312/349

[51] Int. Cl.[2] ..... A47B 77/04; A47B 81/06; A47B 87/00; A47B 88/14

[58] Field of Search ..... 312/8, 205, 237, 239, 249, 312/250, 273, 330, 334, 7 R, 107, 198, 201, 204, 223

[56] References Cited

UNITED STATES PATENTS

| | | | |
|---|---|---|---|
| 936,969 | 10/1909 | Williams | 312/250 X |
| 1,470,243 | 10/1923 | Panico | 312/107 X |
| 1,929,063 | 10/1933 | Hampton | 312/107 |
| 1,994,857 | 3/1935 | Krause | 312/237 X |
| 2,260,586 | 10/1941 | Sheldon | 312/205 X |
| 2,577,850 | 12/1951 | Holmes | 312/273 X |
| 3,459,463 | 8/1969 | Nacht | 312/250 X |

FOREIGN PATENTS OR APPLICATIONS

| | | | |
|---|---|---|---|
| 433,124 | 8/1935 | United Kingdom | 312/107 |

*Primary Examiner*—Paul R. Gilliam
*Assistant Examiner*—Carl F. Pietruszka
*Attorney, Agent, or Firm*—James L. Kirschnik

[57] ABSTRACT

A combination home stereo entertainment center and bar includes slidable supports for the stereo system to provide access to the stereo components from an open rear bar section. The system is supported independently of the bar itself to prevent motion of the bar from being transmitted to the stereo system. Rollable supports are provided to maintain the stereo system level while it is in a withdrawn position relative to the bar. A window may be provided in the front of the bar for viewing and highlighting the stereo system.

3 Claims, 6 Drawing Figures

COMBINATION STEREO-BAR

BACKGROUND OF THE INVENTION

In recent years stereo sound systems have become increasingly popular as home entertainment devices. Such systems typically may include an amplifier, tape player, record player or turntable, and speakers. The stereo components may be in the form of separate units or they may be included in a single cabinet. Turntables are particularly sensitive to vibrations and are preferably placed in a steady, vibration free location. Stereo components are also the object of curious youngsters' attention and are best placed in a location which is secure from young fingers. Home bars have also become popular, however, the combination of a bar and stereo system in one unit has not been practical since activity around a bar would generally result in jolts to the stereo system.

SUMMARY OF THE INVENTION

The present invention combines a bar and stereo sound system by providing independent supporting structures for a bar and a stereo system to prevent shocks and jolts to the bar from being transmitted to the stereo. The bar serves as a protective enclosure for the stereo system and sliding supports enable the stereo to be withdrawn from the bar for easy accessibility.

DESCRIPTION OF A PREFERRED EMBODIMENT

Figure 1:
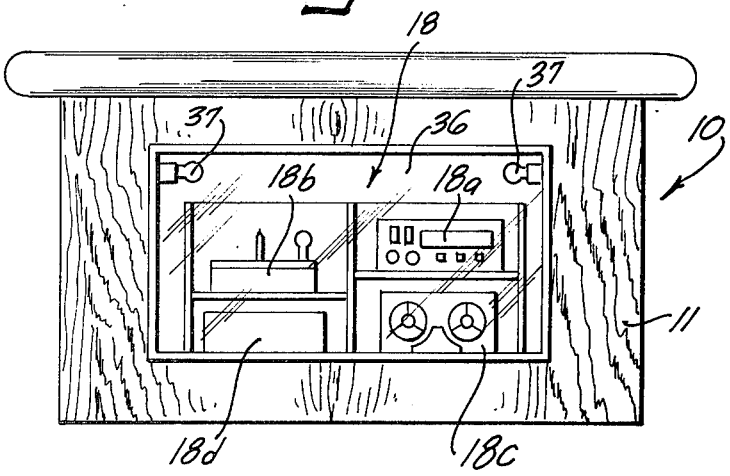
FIG. 1 is a front view of a stereo system-bar combination according to the invention.
Figure 2:
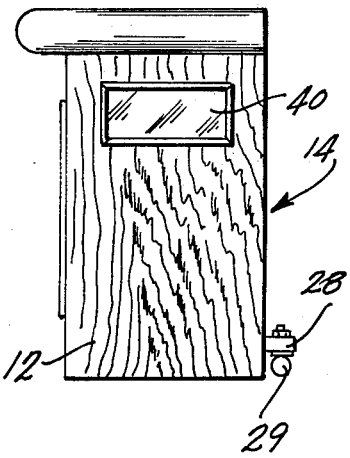
FIG. 2 is a side view of the combination shown in FIG. 1.
Figure 3:
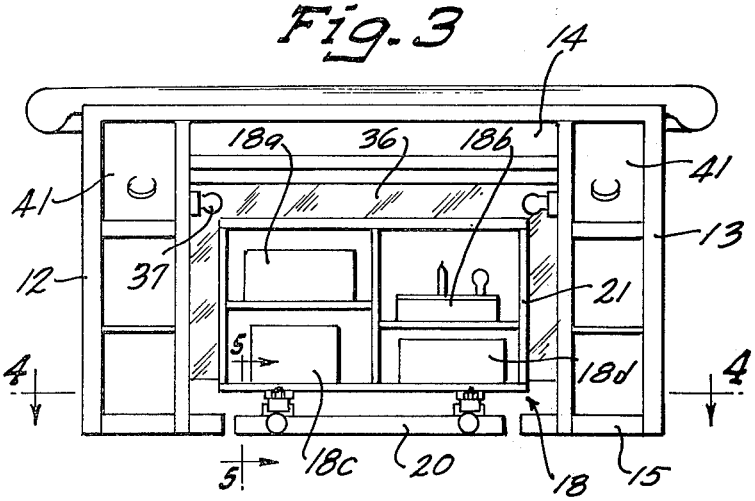
FIG. 3 is a rear view of the combination shown in FIG. 1.
Figure 6:
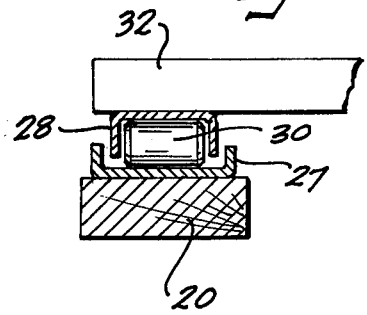
FIG. 6 is a view taken along line 6—6 of FIG. 5.
Figure 4:
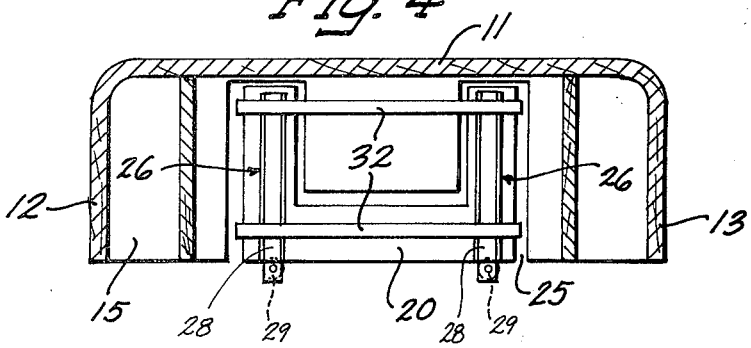
FIG. 4 is a view taken along line 4—4 of FIG. 3.
Figure 5:
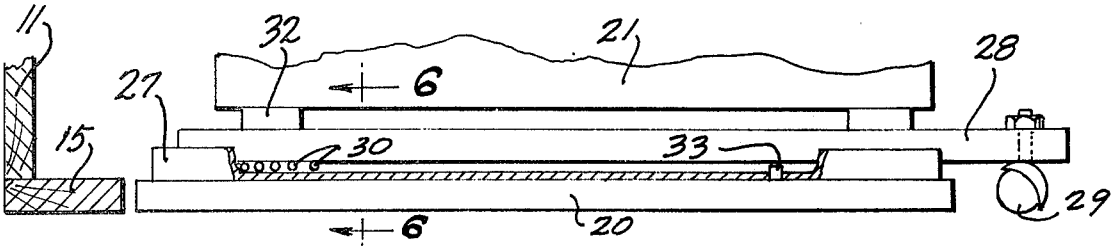
FIG. 5 is a view taken along line 5—5 of FIG. 3.

Referring to FIGS. 1–3, the invention generally comprises an upstanding bar 10 having a front wall 11, and side walls 12 and 13 supported on a base 15, and an open back 14. A stereo system 18 is located within the bar 10 and is supported on a separate base section 20. Stereo system 18 may comprise various individual components **18*a*–18*d* mounted on shelf unit 21** or they may be contained in a separate cabinet (not shown).

With reference to FIGS. 3–6, the support structure for the stereo system 18 is shown. The base 15 of bar 10 has a generally U-shaped cutout 25 and the stereo support base 20 has a similar but slightly smaller U-shaped configuration, which rests in a spaced relationship within cutout 25. Horizontally extending, parallel track assemblies 26 are mounted on the legs of base 20 and extend rearwardly from bar 10 perpendicular to front wall 11. The track assemblies each comprise a fixed track member 27 affixed to base 20 and a sliding member 28 which extends outwardly from the rear of bar 10. A ball type caster 29 is affixed to the extension of each sliding member 28 and rests on the floor upon which the bases 15 and 20 rest. The sliding members 28 may be rollingly supported on bearings 30 within the track members 27 at their inner ends. Two or more parallel frame members 32 may be affixed to the tops of sliding members 28 in a crosswise direction and the shelf unit 21 may be fixedly mounted thereon. Stops 33 may be provided in tracks 27 to limit the rearward travel of the sliding member 28.

As seen in FIGS. 1 and 3, the front of bar 10 may include a clear acrylic window 36 to enable the stereo system 18 to be seen. To highlight the stereo system 19, lights 37 may be provided adjacent the interior of window 36. Additionally, similar windows 40 may be provided in the side walls 12 and 13 to permit viewing of the contents of drawers 41 as seen in FIGS. 2 and 3.

While one embodiment of the invention has been described, it will be apparent that other variations are possible without departing from the inventive concept. While the stereo system 18 has been shown on shelf unit 21, the system could be contained in its own cabinet slidably supported on base 20. The components **18*a–d* have been illustrated as facing the front of bar 10 which prevents tampering with their controls after adjustment. Naturally they could also be placed in a rearward direction eliminating the need or value of window 36. Additionally, the components 18*a–d* could also be individually mounted on slidable shelves of the shelf unit 21 to facillitate individual access. The wiring for stereo system 18 and lights 37 has not been shown and may be of any conventional design or arrangement. The stereo speakers may also be provided as an integral part of bar 10** or as separately located items. Finally, although a stereo system has been depicted, any similar sound system such as a high fidelity system could be used.

Having thus described a preferred embodiment, the scope of the invention is not intended to be limited thereby, but is to be taken solely from an interpretation of the claims which follow.

I claim:

1. In a bar having a first support base, substantially vertical front and side walls and an open back, the improvement comprising:

second support base means adapted to fit substantially within said walls and within an opening in said first support base whereby said second support base means is isolated relative to said first support base and vibrations of said first support base will not be transmitted to said second support means, sliding means mounted on said second support means for slidably supporting a sound system within said bar, said means being adapted to permit movement of said sound system between a first position within said walls and a second position outside of said bar, said bar having a transparent window in at least one wall for viewing said sound system, and illuminating means mounted on said bar for accentuating said sound system.

2. The invention set forth in claim 1 wherein:

said sliding means comprise at least one track member affixed to said second support means and a sliding member bilaterally movably mounted in said track member, said sound system being mounted on said sliding member.

3. In a bar having a first support base, substantially vertical front and side walls and an open back, the improvement comprising:

second support base means adapted to fit substantially within said walls and within an opening in said second support base means whereby said second support base means is isolated relative to said first support base and vibrations of said first support base will not be transmitted to said second support means, sliding means mounted on said second support means for slidably supporting a sound system within said bar, said sliding means being adapted to permit movement of said sound system between a first position within said walls and a second position outside of said bar, said sliding means comprising at least one track member affixed to said second support means and a sliding member bilaterally movably mounted in said track member, said sound system being mounted on said sliding member, said sliding member having one end extending from said bar, means for rollably supporting said one end during movement along said track member, said bar having a transparent window in at least one wall for viewing said sound system, and illuminating means mounted on said bar for accentuating said sound system.

* * * * *